US012016441B2

(12) United States Patent
Garetson

(10) Patent No.: US 12,016,441 B2
(45) Date of Patent: Jun. 25, 2024

(54) BAND WALLET

(71) Applicant: Josiah Garetson, Singapore (SG)

(72) Inventor: Josiah Garetson, Singapore (SG)

( * ) Notice: Subject to any disclaimer, the term of this patent is extended or adjusted under 35 U.S.C. 154(b) by 484 days.

(21) Appl. No.: 17/157,762

(22) Filed: Jan. 25, 2021

(65) Prior Publication Data

US 2021/0227944 A1 Jul. 29, 2021

Related U.S. Application Data

(60) Provisional application No. 62/965,291, filed on Jan. 24, 2020.

(51) Int. Cl.
*A45C 11/18* (2006.01)
*A45C 1/06* (2006.01)

(52) U.S. Cl.
CPC ..... *A45C 11/182* (2013.01); *A45C 1/06* (2013.01); *A45C 2001/065* (2013.01)

(58) Field of Classification Search
CPC .... A45C 11/182; A45C 1/06; A45C 2001/065
See application file for complete search history.

(56) References Cited

U.S. PATENT DOCUMENTS

2002/0157745 A1* 10/2002 Stodghill ..... A45C 1/06 150/145
2004/0172789 A1* 9/2004 Lehr ..... B65D 63/109 24/17 AP
2009/0211062 A1* 8/2009 Preston-Hall ..... A45C 1/08 24/17 B

* cited by examiner

*Primary Examiner* — Sue A Weaver

(57) ABSTRACT

A band wallet includes a retention band, the retention band includes a flat band body, a first band end, and a second band end. The flat band body further comprises a first lengthwise face and a second lengthwise face. The first band end is mounted to the second band end, forming the flat band body into a closed loop with a lengthwise 360-degree twist. Accordingly, the first lengthwise face and the second lengthwise face form continuous surfaces across the conjunction of the first band end and the second band end, enabling the flat band body to lay flat across centrally retained items such as one or more credit cards. More specifically, the lengthwise 360-degree twist is defined along the flat band body prevents the bunching of the constituent material of the band as said flat band body traverses about the edges of such an article.

13 Claims, 6 Drawing Sheets

BAND WALLET

The current application claims a priority to the U.S. Provisional Patent application Ser. No. 62/965,291 filed on Jan. 24, 2020. The current application is filed on Jan. 25, 2021 while Jan. 24, 2021 was on a weekend.

FIELD OF THE INVENTION

The present invention relates generally to an apparatus for retaining and storing credit cards, identification cards, paper currency, or otherwise fulfilling the functions of a conventional wallet. More specifically, the present invention is a novel configuration of elastic elements arranged to provide expandable storage for said articles.

BACKGROUND OF THE INVENTION

Conventional wallets—specifically referring to a folding, pocketed organizer for credit cards, identification, loose bank notes, and the like—are ubiquitous in use today. Typical construction of these wallets leaves much to be desired, as overfilling can cause unseemly bulging around the middle of the wallet as it stretches to accommodate its contents. As modern transactions trend towards the use of digital payment options (credit cards, mobile payment options, and the like), the use of cash has decreased. However, the need to retain a larger number and greater variety of cards has highlighted the shortcomings of conventional wallet designs. With each internal pocket individually separated, the effective girth of each card may be tripled to account for pocket sidewalls between each card. In practice, a conventionally constructed wallet cannot support the daily needs of a modern user without grossly oversized embodiments to account for the necessary storage space in an enclosed wallet.

In lieu of this outdated model, an objective of the present invention is to provide a lightweight-low-profile, flexible wallet may better serve the needs of modern consumers. Given that the average plastic or metal card is more durable than paper money, the full enclosure of the wallet may be dispensed with. Further, the cards themselves are rigidly uniform in ways that banknotes cannot be, thereby enabling the contents of an ultralight wallet to lend form and structure to the wallet itself. This arrangement enables the necessary functions of a wallet as a storage medium while drastically reducing the wasted space of an empty wallet, or the bloat of an overfilled wallet.

DETAIL DESCRIPTIONS OF THE INVENTION

All illustrations of the drawings are for the purpose of describing selected versions of the present invention and are not intended to limit the scope of the present invention.

As shown in FIG. 1 through 6, the preferred embodiment of the present invention provides an adjustable, expandable storage device via a novel arrangement of tensile and elastic members operatively configured to form discrete storage areas. More specifically, the present invention defines a specific series of contortions and fixations applied to an otherwise conventional elongate textile that provide novel functionality as a wallet. In contrast to existing low-profile wallets that only contain cards, the discrete storage areas supported within the present invention provides the flexibility to store cards of any size, folded banknotes, or any other item while maintaining a minimalist form factor. The expandable construction of the present invention further enables multiple items to be retained in an individual storage area, including mixed collections of dissimilar items within a single instance of said storage area.

Figure 1:
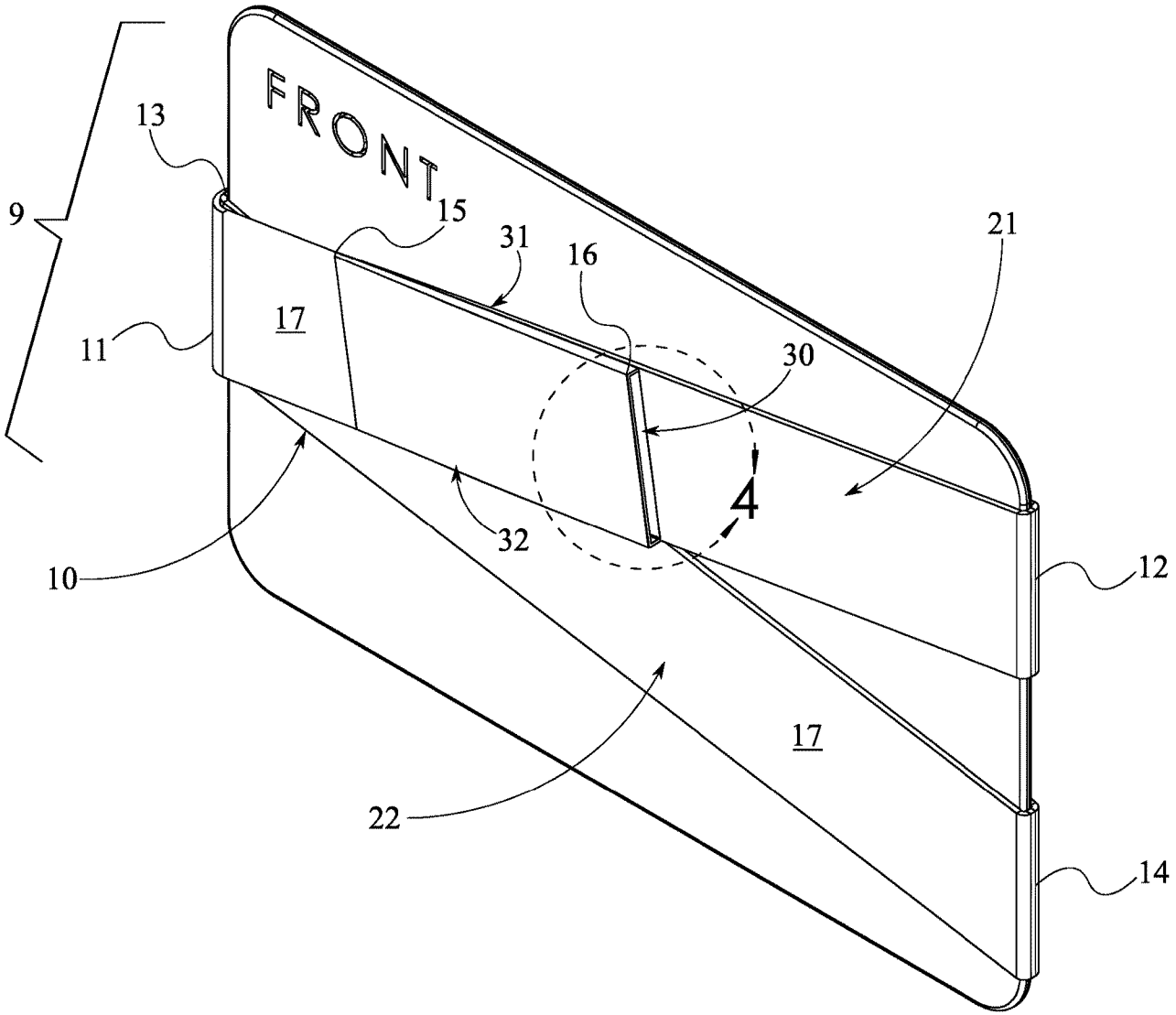
FIG. 1 is a top-front-left perspective view of the present invention, wherein the present invention is engaged about an exemplary blank card to illustrate an operative configuration.
Figure 2:
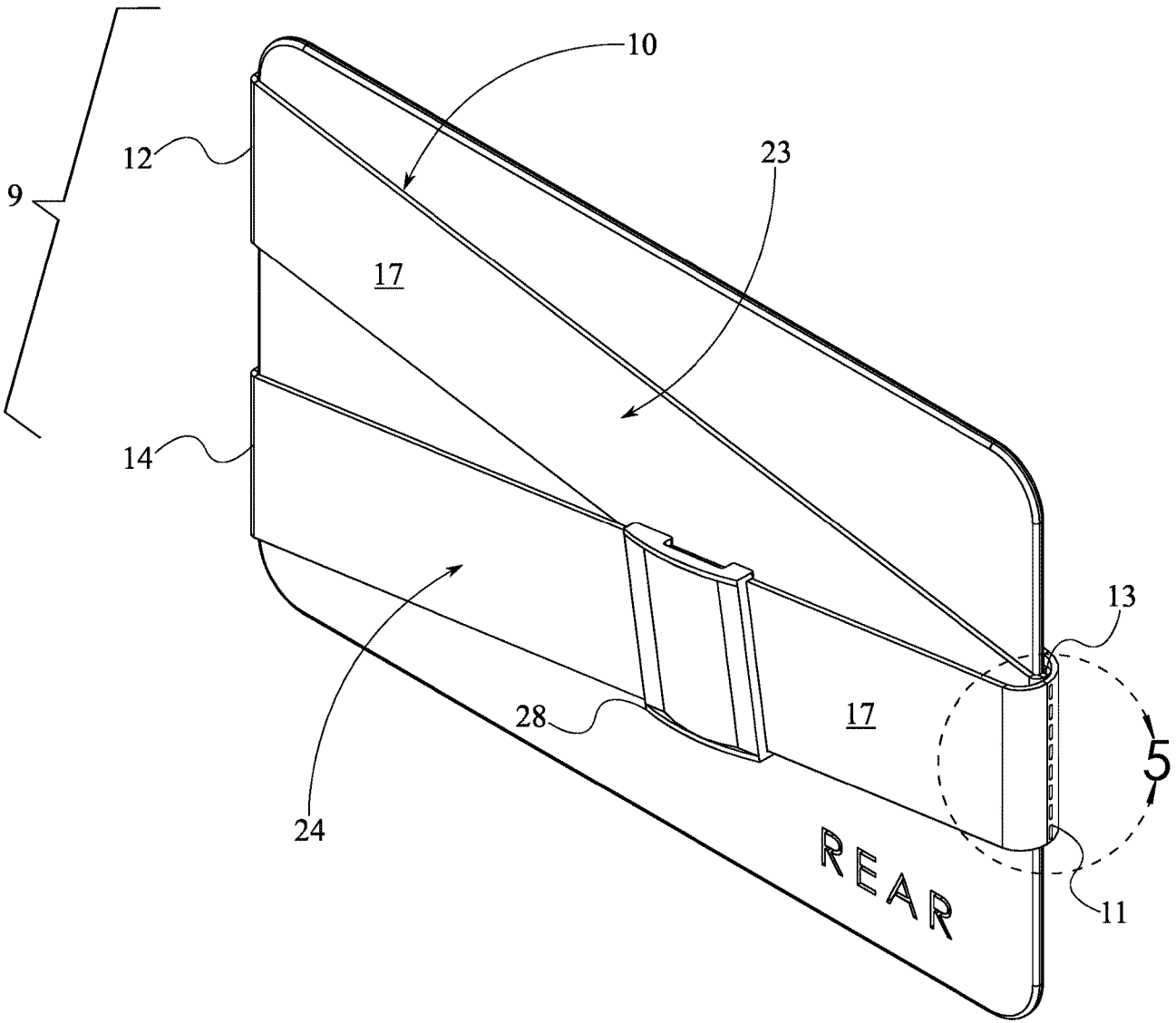
FIG. 2 is top-rear-right perspective view thereof.

In reference to FIG. 1, to achieve the above-described functionalities, the present invention comprises a retention band 9. The retention band 9 broadly refers to a substantially elastic strap suitable for binding a collection of items into a series of contortions, defining and delineating the discrete storage areas of the present invention. The retention band 9 comprises a flat band body 10, a first band end 15, and a second band end 16. The flat band body 10 further comprises a first lengthwise face 17 and a second lengthwise face 18. The first band end 15 is mounted to the second band end 16, with the flat band body 10 being arranged into a closed loop with a lengthwise 360-degree twist. The flat band body 10 constitutes an elongated structural member extending between the first band end 15 and the second band end 16, wherein the composition of the flat band body 10 is substantially elastic. In the preferred embodiment, the elasticity of the flat band body 10 is proposed to be uniform between the first band end 15 and the second band end 16. In various alternate embodiments, the composition of the flat band body 10 may include elastic sections interspersed by tensile sections. This alternate composition may extend to include a hybridization of dislike materials in at least one embodiment, while still retaining an overall elasticity between the first band end 15 and the second band end 16. According to this varied embodiment, the first band end 15 and the second band end 16 may be mounted to each other utilizing stitching, contact-welding, chemical adhesives, or any other suitable means of affixing the flat band body 10 into a closed loop. Further, the lengthwise 360-degree twist is defined by a double-inversion of the first lengthwise face 17 and the second lengthwise face 18 about the closed loop. This arrangement allows the flat band body 10 to remain flush with any items retained therein, specifically preventing any material bunching or deformations caused by wrapping around said items. As shown in FIGS. 1 and 2, the first lengthwise face 17 remains facing nominally outward from the exemplary card despite multiple interplanar transformations that would otherwise coil the flat band body 10 lengthwise. As further illustrated in FIG. 6, the second lengthwise face 18 consistently remains facing nominally inward towards the exemplary card through all transformations.

More specifically, the retention band 9 is arranged into an operative configuration, wherein the flat band body 10 further comprises a first inflection 11, a second inflection 12, a third inflection 13, and a fourth inflection 14. The first inflection 11, the second inflection 12, the third inflection 13, and the fourth inflection 14 are serially distributed along the flat band body 10, ideally corresponding to areas wherein the flat band body 10 pivots about the lateral edges of a retained item. Inflection, as used in reference to these contortions, refers to the geometric term for a point of a continuous curve where the curvature changes sign. As shown in FIGS. 1 and 2, the first inflection 11, the second inflection 12, the third inflection 13, and the fourth inflection 14 each define a 180-degree lateral change in direction and a 90-degree torsional transformation. According to the preferred embodiment, the first inflection 11 encloses a first lateral edge of an exemplary card, the second inflection 12 encloses a second lateral edge of the exemplary card, the third inflection 13 encloses the first lateral edge again, and the fourth inflection 14 encloses the second lateral edge again.

The first inflection 11, the second inflection 12, the third inflection 13, and the fourth inflection 14 functionally delineate the ranges of specific sections of the flat band body 10. Accordingly, the interstitial spaces constitute flexible storage areas suitable for storing a variety of personal items as previously outlined. As shown in FIGS. 1 and 2, a first body portion 21 of the flat band body 10 traverses from the first inflection 11 to the second inflection 12, a second body portion 22 of the flat band body 10 traverses from the third inflection 13 to the fourth inflection 14, and a first lateral card-receiving pocket 25 is formed in between the first body portion 21 and the second body portion 22. The first lateral card-receiving pocket 25 is proposed to be laterally expansive to the extent that the flat band body 10 is elastic, whereby additional lengths of flat band body 10 may be drawn into the first body portion 21 to enclose any collection of items inserted into the first card-receiving pocket. This expansion of the first lateral card-receiving pocket 25 via the lengthening of the first body portion 21 corresponds to a migration of the first inflection 11 and the second inflection 12 closer to the third inflection 13 and the fourth inflection 14 along the flat band body 10.

Figure 3:
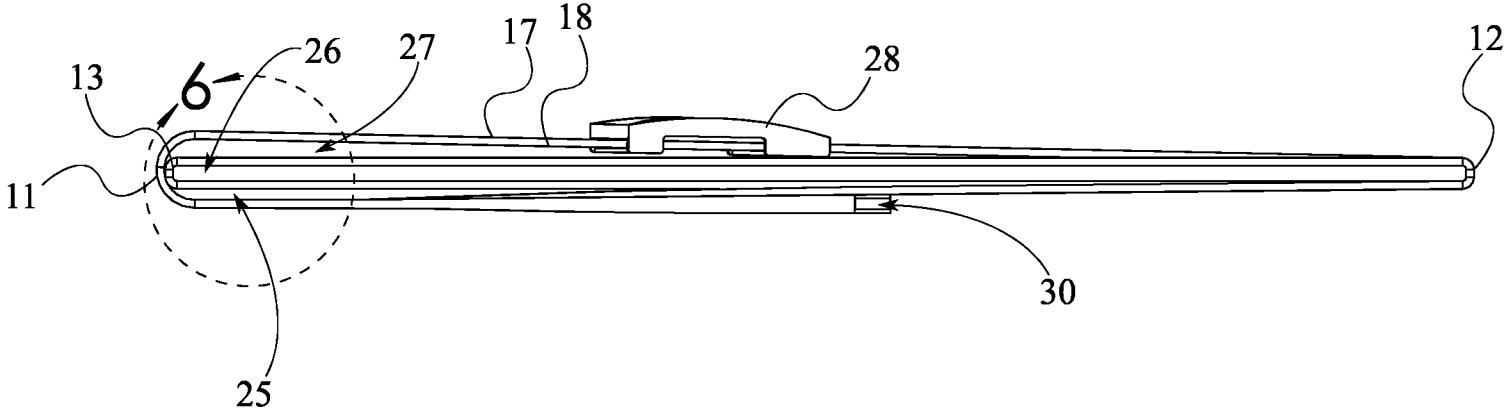
FIG. 3 is a top elevational view of the present invention, wherein the exemplary blank card is omitted for clarity.

Similarly, a second body portion 22 of the flat band body 10 traverses from the third inflection 13 to the fourth inflection 14, a third body portion 23 of the flat band body 10 traverses from the second inflection 12 to the third inflection 13, and a central card-receiving pocket 26 is formed in between the second body portion 22 and the third body portion 23. This formation is functionally similar to the first lateral card-receiving pocket 25, wherein an expandable storage area is defined and delineated by opposed lengths of the flat band body 10. Likewise, a third body portion 23 of the flat band body 10 traverses from the second inflection 12 to the third inflection 13, a fourth body portion 24 of the flat band body 10 traverses from the first inflection 11 to the fourth inflection 14, and a second lateral card-receiving pocket 27 is formed in between the third body portion 23 and the fourth body portion 24. Collectively, the first lateral card-receiving pocket 25, the central card-receiving pocket 26, and the second lateral card-receiving pocket 27 define all discrete enclosed geometry of the contorted self-enclosing configuration of the retention band 9 as shown in FIG. 3. It is proposed that the central card-receiving pocket 26 serves as a primary storage area, wherein the shape of the retained object defines the geometry of the first lateral card-receiving pocket 25 and the second lateral card-receiving pocket 27 formed on opposed sides of the centrally retained item (e.g., a credit card forming elongate storage areas).

Figure 5:
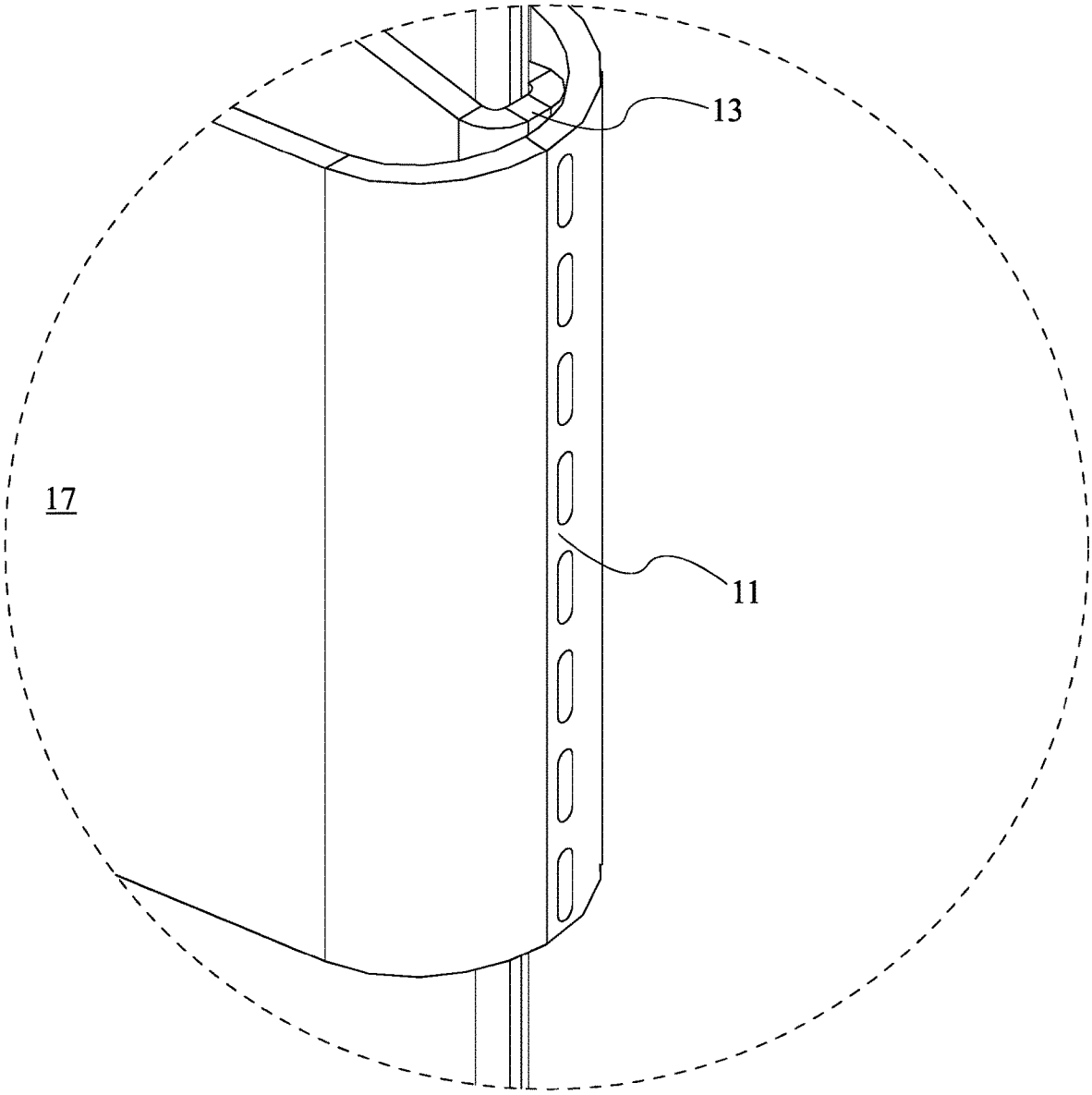
FIG. 5 is an enlarged detail taken about circle 5 in FIG. 2.
Figure 6:
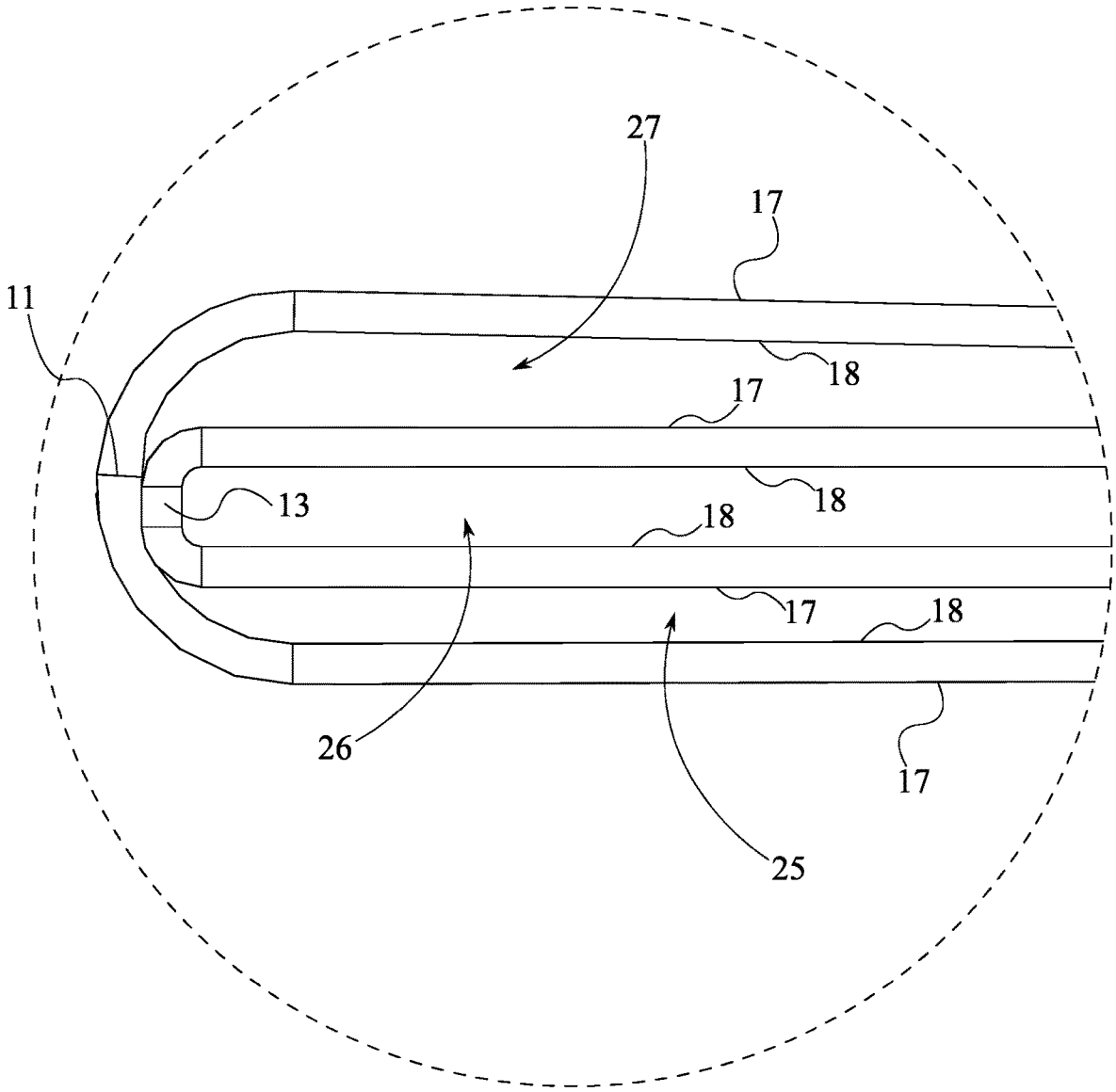
FIG. 6 is an enlarged detail taken about circle 6 in FIG. 3.

In at least one embodiment, the first inflection 11 point and the third inflection 13 point are fixed onto each other as shown in FIG. 5. Providing a permanent, fixed division point between halves of the flat band body 10 enables a user to fill the first lateral card-receiving pocket 25 without overextending the flat band body 10. This overextension would excessively limit the capacity of the second lateral card-receiving pocket 27, reducing the organizational utility of the separate storage areas. Accordingly, this permanent fixation is ideally formed at diametrically opposed points about the flat band body 10 to provide equal storage capacity to both the first lateral card-receiving pocket 25 and the second lateral card-receiving pocket 27. In some embodiments, the present invention may further comprise a base card, which is a semirigid flat body that mimics the size and shape of a typical credit card. The base card is inserted through the central card-receiving pocket 26 so that the present invention is preformed with the first lateral card-receiving pocket 25, the central card-receiving pocket 26, and the second lateral card-receiving pocket 27. Thus, the base card allows the present invention to readily receive and store card-shaped objects.

Figure 4:
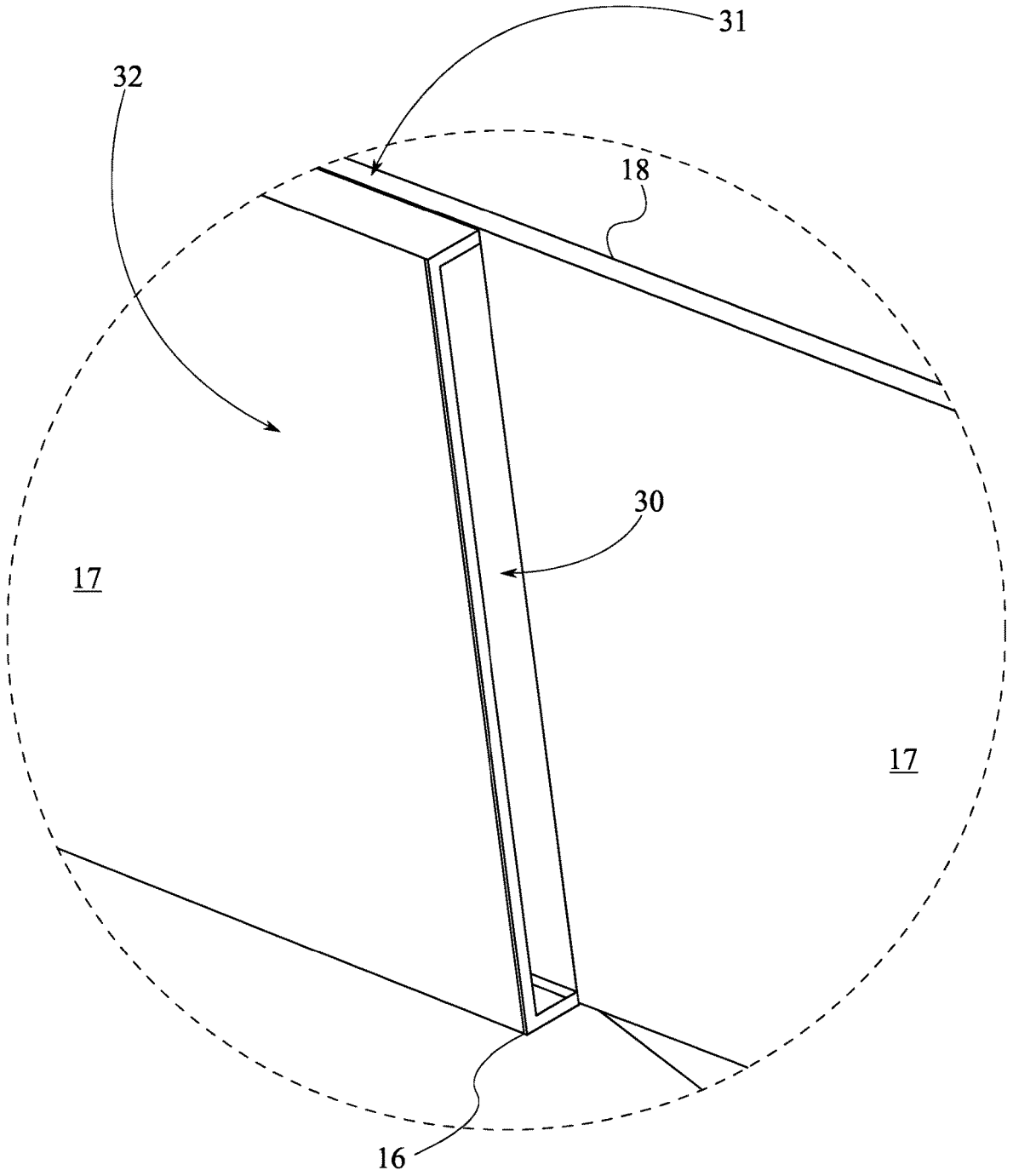
FIG. 4 is an enlarged detail taken about circle 4 in FIG. 1.

In yet another embodiment, the present invention comprises a storage slot 30 laterally integrated into the flat band body 10 as shown in FIG. 4. This ancillary storage area is specifically directed towards storing small items that would be unsuitable for retention within any of the larger open storage areas. Items such as keys, flash memory sticks, small tools, or other such items that must be stored securely are directly considered, though potential uses are not limited to these items. The storage slot 30 may be formed into the existing material of the retention band 9 or attached as a separate module without departing from the original spirit and scope of the present invention.

In at least one embodiment, the flat band body 10 is assembled to form the storage slot 30 as an incident feature of the attachment of the first band end 15 to the second band end 16. Accordingly, a first overlap portion 31 of the flat band body 10 is positioned adjacent to the first band end 15, a second overlap portion 32 of the flat band body 10 is positioned adjacent to the second band end 16, and the first overlap portion 31 and the second overlap portion 32 are connected onto each other. The storage slot 30 is formed in between the first overlap portion 31 and the second overlap portion 32, as shown in FIG. 5. The means of fixing the first overlap portion 31 to the second overlap portion 32 ideally constitute a stitched connection through both areas of the flat band body 10, wherein the stitch-lines progress peripherally along the lateral edges of the first overlap portion 31 and second overlap portion 32. This embodiment may provide an elongate iteration of the storage slot 30 particularly suitable for keys, wherein the total depth of the storage slot 30 is unlimited due to an unseamed or unsealed rearward edge.

It is considered that the maximum storage capacity of the retention band 9 may be expanded beyond the elastic limits of the flat band body 10 in a fixed-length embodiment. Therefore, the present invention may comprise a length-adjusting mechanism 28. The length-adjusting mechanism 28 is operatively integrated along the flat band body 10, wherein the length-adjusting mechanism 28 is used to adjust a circumference of the closed loop. The length-adjusting mechanism 28 is broadly contemplated to define any means of operably taking up slack in the flat band body 10 to ensure proper fitment of the present invention to any items retained therein by reducing the maximum circumference of the closed loop. Conversely, the length-adjusting mechanism 28 may unspool or release lengths of the flat band body 10 to increase the maximum circumference of the closed loop, increasing the storage capacity of the present invention. As shown in exemplary form in FIG. 5, passive mechanical fixtures such as a double-pass buckle may effectively reduce the circumference of the closed loop by introducing complications to the normal path of the flat band body 10.

Although the invention has been explained in relation to its preferred embodiment, it is to be understood that many other possible modifications and variations can be made without departing from the spirit and scope of the invention as hereinafter claimed.

What is claimed is:

1. A band wallet comprising:

a retention band;

the retention band comprising a flat band body, a first band end, and a second band end;

the flat band body comprising a first lengthwise face and a second lengthwise face;

the first band end being mounted to the second band end; and the flat band body being arranged into a closed loop with a lengthwise 360-degree twist.

2. The band wallet as claimed in claim 1 comprises:

wherein the retention band is arranged into an operative configuration;

the flat band body further comprising a first inflection, a second inflection, a third inflection, and a fourth inflection; and the first inflection, the second inflection, the third inflection, and the fourth inflection being serially distributed along the flat band body.

3. The band wallet as claimed in claim 2 comprises:

a first body portion of the flat band body traversing from the first inflection to the second inflection;

a second body portion of the flat band body traversing from the third inflection to the fourth inflection; and a first lateral card-receiving pocket being formed in between the first body portion and the second body portion.

4. The band wallet as claimed in claim 3 comprises:

a third body portion of the flat band body traversing from the second inflection to the third inflection; and a central card-receiving pocket being formed in between the second body portion and the third body portion.

5. The band wallet as claimed in claim 4 comprises:

a fourth body portion of the flat band body traversing from the first inflection to the fourth inflection; and a second lateral card-receiving pocket being formed in between the third body portion and the fourth body portion.

6. The band wallet as claimed in claim 2 comprises:

the first inflection point and the third inflection point being fixed onto each other.

7. The band wallet as claimed in claim 1 comprises:

a storage slot; and the storage slot being laterally integrated into the flat band body.

8. The band wallet as claimed in claim 7 comprises:

a first overlap portion of the flat band body being positioned adjacent to the first band end;

a second overlap portion of the flat band body being positioned adjacent to the second band end;

the first overlap portion and the second overlap portion being connected onto each other; and the storage slot being formed in between the first overlap portion and the second overlap portion.

9. The band wallet as claimed in claim 1 comprises:

a length-adjusting mechanism; and the length-adjusting mechanism being operatively integrated along the flat band body, wherein the length-adjusting mechanism is used to adjust a circumference of the closed loop.

10. A band wallet comprising:

a retention band;

the retention band comprising a flat band body, a first band end, and a second band end;

the flat band body comprising a first lengthwise face and a second lengthwise face;

the first band end being mounted to the second band end;

the flat band body being arranged into a closed loop with a lengthwise 360-degree twist;

wherein the retention band is arranged into an operative configuration;

the flat band body further comprising a first inflection, a second inflection, a third inflection, and a fourth inflection;

the first inflection, the second inflection, the third inflection, and the fourth inflection being serially distributed along the flat band body;

a storage slot; and the storage slot being laterally integrated into the flat band body.

11. The band wallet as claimed in claim 10 comprises:

a first body portion of the flat band body traversing from the first inflection to the second inflection;

a second body portion of the flat band body traversing from the third inflection to the fourth inflection;

a first lateral card-receiving pocket being formed in between the first body portion and the second body portion;

a third body portion of the flat band body traversing from the second inflection to the third inflection;

a central card-receiving pocket being formed in between the second body portion and the third body portion;

a fourth body portion of the flat band body traversing from the first inflection to the fourth inflection; and a second lateral card-receiving pocket being formed in between the third body portion and the fourth body portion.

12. The band wallet as claimed in claim 10 comprises:

the first inflection point and the third inflection point being fixed onto each other;

a first overlap portion of the flat band body being positioned adjacent to the first band end;

a second overlap portion of the flat band body being positioned adjacent to the second band end;

the first overlap portion and the second overlap portion being connected onto each other; and the storage slot being formed in between the first overlap portion and the second overlap portion.

13. The band wallet as claimed in claim 10 comprises:

a length-adjusting mechanism; and the length-adjusting mechanism being operatively integrated along the flat band body, wherein the length-adjusting mechanism is used to adjust a circumference of the closed loop.

* * * * *